US005918319A

United States Patent [19]

Baxter

[11] Patent Number: 5,918,319

[45] Date of Patent: Jul. 6, 1999

[54] PROTECTIVE GARMENT INCORPORATING AN ABRASION-RESISTANT FABRIC

[76] Inventor: Hal Thomas Baxter, P.O. Box 1852, Hickory, N.C. 28601

[21] Appl. No.: 08/862,725

[22] Filed: May 23, 1997

Related U.S. Application Data

[63] Continuation-in-part of application No. 08/634,839, Jul. 22, 1996, abandoned.

[51] Int. Cl.[6] ..... A41D 13/00; A41D 1/06; A41D 13/06

[52] U.S. Cl. ..... 2/455; 2/22; 2/23; 66/191; 66/194; 66/202; 66/170

[58] Field of Search ..... 2/455, 456, 459, 2/460, 461, 462, 463, 464, 465, 466, 467, 2.5, 22, 23, 24, 46, 79, 227, 243.1, 69, 69.5; 66/169 R, 170, 171, 191, 194, 202

[56] References Cited

U.S. PATENT DOCUMENTS

| | | | |
|---|---|---|---|
| 907,050 | 12/1908 | Hestness | 2/23 |
| 2,589,636 | 3/1952 | Smith | 2/94 |
| 3,191,185 | 6/1965 | Martin . | |
| 3,250,095 | 5/1966 | Kingman . | |
| 4,133,147 | 1/1979 | Swift, Jr. | 51/100 |
| 4,280,342 | 7/1981 | Eng et al. | 2/455 |
| 4,351,065 | 9/1982 | Bouchard | 2/23 |
| 4,987,613 | 1/1991 | Loverdi et al. . | |
| 5,095,544 | 3/1992 | Elverskog . | |
| 5,161,257 | 11/1992 | Arensdorf et al. | 2/23 |
| 5,224,363 | 7/1993 | Sutton | 2/455 |
| 5,267,354 | 12/1993 | Grilliot . | |
| 5,415,007 | 5/1995 | Eng | 2/22 |
| 5,625,895 | 5/1997 | Sovereign | 2/22 |

FOREIGN PATENT DOCUMENTS 2 226 943 7/1990 United Kingdom .

OTHER PUBLICATIONS

Magazine Advertisement; "The Practical All Rounder"; Gialf Jeans 600; Date Published—prior to May 23, 1997.

*Primary Examiner*—Jeanette Chapman
*Attorney, Agent, or Firm*—Adams Law Firm, P.A.

[57] ABSTRACT

A protective garment includes an abrasion-resistant fabric attached to an inside of the garment, and having a face side residing adjacent the garment and a back side for residing nearest the wearer. The fabric includes a body yarn, and an elastic yarn incorporated with the body yarn. A high performance yarn is incorporated with the body yarn and the elastic yarn, and terried to form loops extending from the face side of the fabric adjacent the garment. The high performance yarn has a tensile strength of at least 7 grams per denier.

13 Claims, 5 Drawing Sheets

PROTECTIVE GARMENT INCORPORATING AN ABRASION-RESISTANT FABRIC

This application is a continuation-in-part application of U.S. Ser. No. 08/634,839, filed on Jul. 22, 1996, now abandoned.

TECHNICAL FIELD AND BACKGROUND OF THE INVENTION

The invention relates to protective garments, such as pants and jackets, incorporating an abrasion-resistant fabric. The invention is particularly suited for wear by motorcyclists to protect the wearer from abrasion injuries in the event of an accident. The fabric of the invention is incorporated into conventional denim jeans and jackets to provide stylish, relatively inexpensive protective garments. The fabric is breathable, strong, light weight, fatigue and damage resistant, and thermally stable. Garments incorporating the fabric are launderable using conventional home washers and dryers without diminishing the abrasion-resistant characteristics of the fabric.

The fabric of the invention incorporates a high performance fiber, such as KEVLAR brand aramid manufactured by DuPont, terried on a face side of the fabric and residing adjacent to the shell fabric of the garment. The aramid fibers are thermally stable up to 800 to 900 degrees F., as compared to cotton which starts to decompose at 300 to 400 degrees F. Additionally, these fibers do not melt like nylon or polyester fibers. Thus, while the heat and friction generated when sliding on pavement or other abrasive surface quickly tears away the cotton fabric of the garment, the high performance aramid fibers of the present fabric maintain their structure and effectively disperse the heat as the individual terried fibers ride up, around, and over the abrasive surface. The fabric provides a strong and comfortable protective shield between the abrasive surface and the skin of the wearer to reduce abrasion injuries.

The KEVLAR aramid fibers are five times as strong as steel on a weight basis, but 43% lower in density than fiberglass. The present fabric thus adds little weight to the garment, while substantially increasing its strength and abrasion resistance. The abrasion-resistance of these fibers has been proven in tests on logging trucks in British Columbia. Brakes on these trucks reinforced with KEVLAR lasted 12 times longer than asbestos and three times longer than semi-metallics.

SUMMARY OF THE INVENTION

Therefore, it is an object of the invention to provide a protective garment which incorporates an abrasion-resistant fabric, and which resembles conventional and stylish denim jeans.

It is another object of the invention to provide a garment which incorporates an abrasion-resistant fabric having excellent cut and heat resistance.

It is another object of the invention to provide a garment which incorporates an abrasion-resistant fabric that is thermally stable up to 800 to 900 degrees F.

It is another object of the invention to provide a garment which incorporates an abrasion-resistant fabric that does not melt when exposed to high temperatures.

It is another object of the invention to provide a garment which incorporates an abrasion-resistant fabric that is launderable without impacting its cut-resistance.

It is another object of the invention to provide a garment which incorporates an abrasion-resistant fabric that is light weight and fatigue and damage resistant.

It is another object of the invention to provide a garment which incorporates an abrasion-resistant fabric including fibers that are five times as strong as steel on a weight basis but 43% lower in density than fiberglass.

These and other objects of the present invention are achieved in the preferred embodiments disclosed below by providing a protective garment including an abrasion-resistant fabric attached to an inside of the garment, and having a face side residing adjacent the garment and a back side for residing nearest the wearer. The fabric includes a body yarn, and an elastic yarn incorporated with the body yarn. A high performance yarn is incorporated with the body yarn and the elastic yarn, and terried to form loops extending from the face side of the fabric adjacent the garment. The high performance yarn has a tensile strength of at least 7 grams per denier.

According to one preferred embodiment of the invention, the body yarn of the fabric includes fibers selected from the group consisting of nylon, cotton, flax, and hemp.

According to another preferred embodiment of the invention, the elastic yarn of the fabric includes spandex fibers.

According to yet another preferred embodiment of the invention, the high performance yarn of the fabric includes aramid fibers.

According to yet another preferred embodiment of the invention, the fabric is attached to an inside of the garment by sewing stitches.

According to yet another preferred embodiment of the invention, the garment is a pair of pants.

According to yet another preferred embodiment of the invention, the fabric is cut to form a protective knee patch sewn to an inside of the pants in an area of the knees of the wearer.

According to yet another preferred embodiment of the invention, the fabric is cut to form a protective seat patch sewn to an inside of the pants in an area of the seat of the wearer.

According to yet another preferred embodiment of the invention, the garment is a coat.

According to yet another preferred embodiment of the invention, the fabric is cut to form a protective elbow patch sewn to an inside of the coat in an area of the elbow of the wearer.

According to yet another preferred embodiment of the invention, the yarns of the fabric are knit.

According to yet another preferred embodiment of the invention, the yarns of the fabric are woven.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
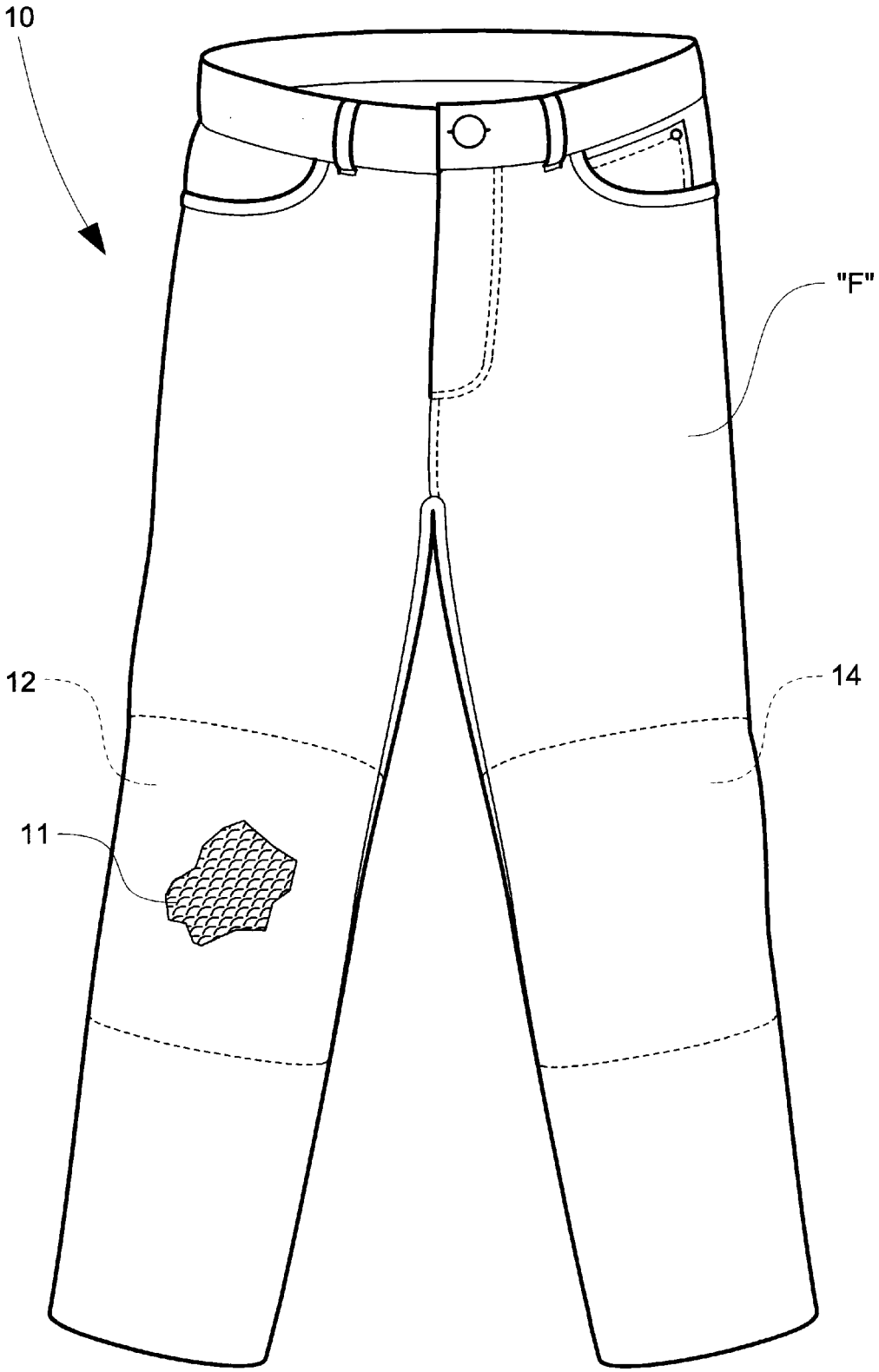
FIG. 1 is a front view of a garment incorporating an abrasion-resistant fabric according to one preferred embodiment of the invention, and showing a portion of the garment torn away to expose the fabric.
Figure 2:
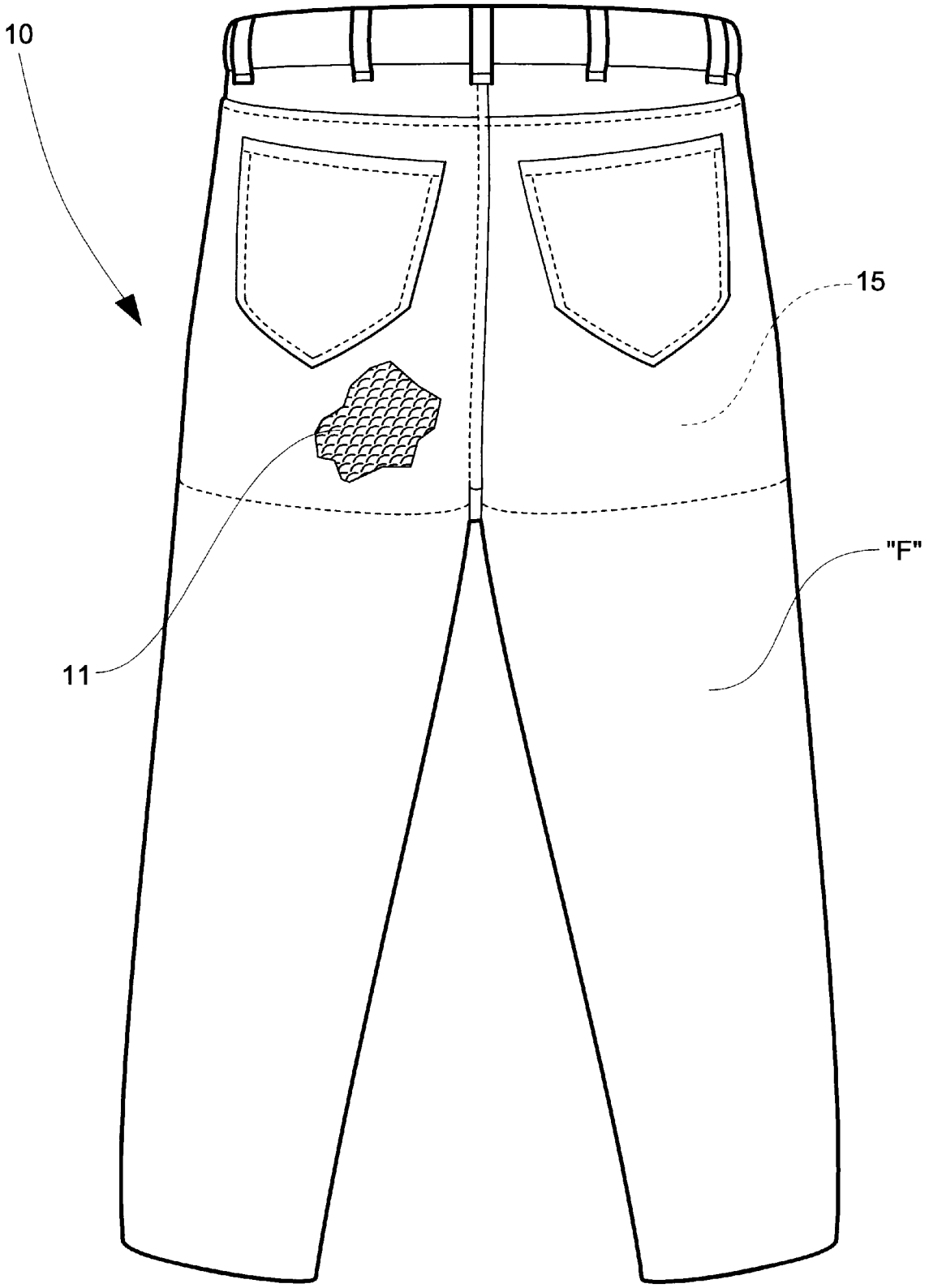
FIG. 2 is a rear view of the garment shown in FIG. 1 with a portion of the garment torn away to expose the fabric.

Referring now specifically to the drawings, a protective garment incorporating an abrasion-resistant fabric according to the present invention is illustrated in FIG. 1 and shown generally at reference numeral 10. The garment 10 is preferably made of denim fabric "F" to resemble conventional denim jeans, and is particularly suitable for wear by motorcyclists. In the event of an accident, the garment 10 protects the skin of the wearer against abrasion injury caused by sliding on pavement or other abrasive surfaces. The novel fabric 11 is preferably cut in patches 12, 14, and 15 which are separately sewn to the inside of the garment in the knee and seat areas, as best shown in FIGS. 1 and 2. Alternatively, the entire inside of the garment 10 may be lined with the fabric 11, although this construction substantially increases cost with little added benefit to the wearer.

Figure 3:
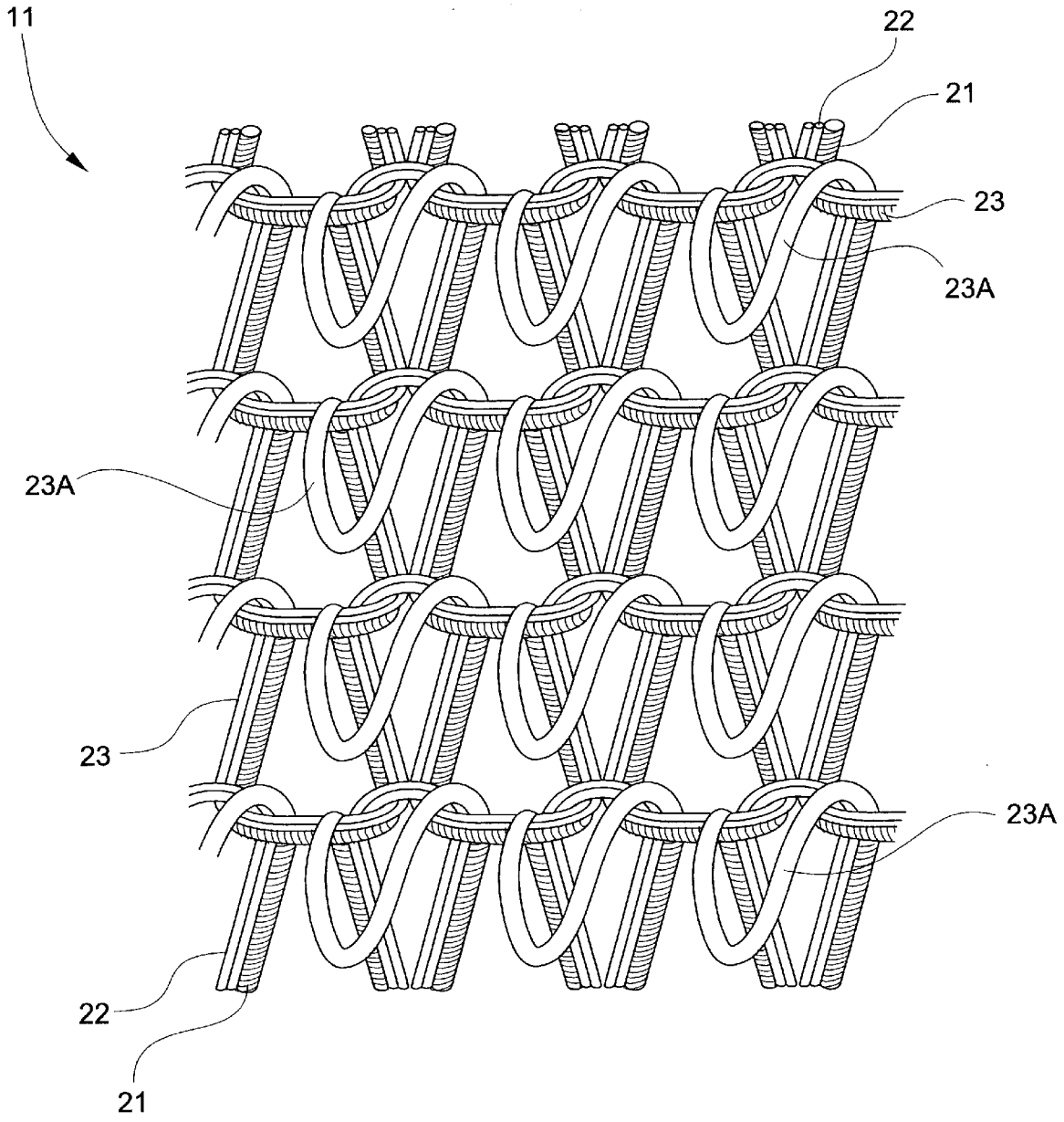
FIG. 3 is a greatly enlarged perspective view of a portion of the fabric.
Figure 4:
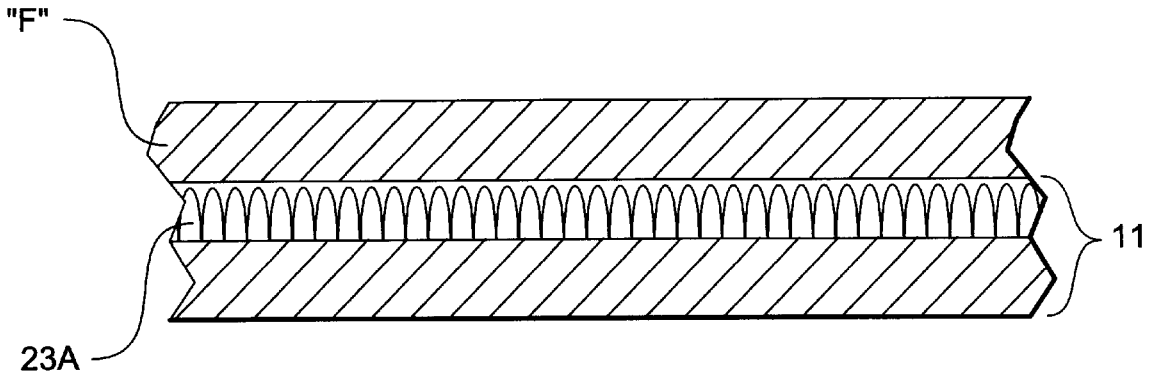
FIG. 4 is a schematic cross-sectional view showing a portion of the garment and fabric.

Referring to FIG. 3, the fabric 11 is constructed of one or more body yarns 21 integrally knit or woven with an elastic yarn 22 and a high-performance yarn 23 having a tensile strength of at least 7 grams/denier. The body yarn 21 is formed of nylon or polyester fibers. The elastic yarn 22 is preferably formed of spandex fibers, such as those manufactured by DuPont and sold under the trademark LYCRA. The high-performance yarn 23 is flat knit on a back side of the fabric 11 and terry knit on a face side of the fabric 11. The terried, face side resides directly adjacent the denim fabric "F" of the garment 10, as shown in FIG. 4, while the back side resides against the skin of the wearer. The high-performance yarn 23 is preferably formed of loosely spun aramid fibers, such as those manufactured by DuPont and sold under the trademark KEVLAR.

Upon contacting an abrasive surface, the individual fibers of the high-performance terried yarn 23 move up, around, and over the surface to absorb shock and snatch loads on the fabric. As the outer denim fabric "F" wears away, the terry loops 23A maintain their structure and function to disperse heat away from the area being abraded. Preferably, the fabric 11 has a minimum of 10% stretch in both warp and fill directions, and a melting temperature in excess of 600 degrees F. In addition, other high-performance or natural yarns, such as cotton, flax, or hemp, may be incorporated into the fabric 11 using standard sewing techniques, such as by plaiting, chopping, splicing, or laying-in these yarns to provide increased comfort and abrasion-resistance.

Figure 5:
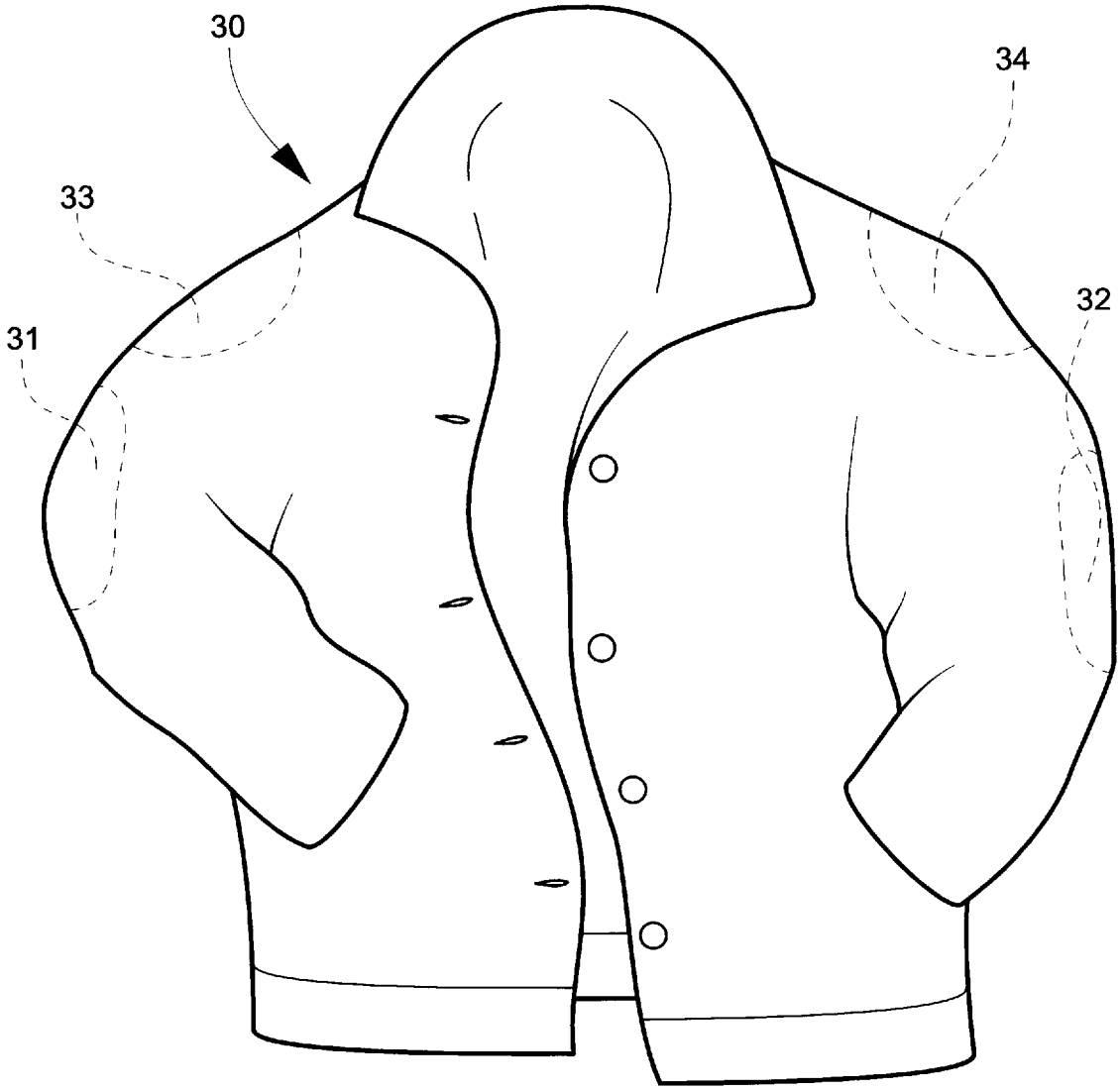
FIG. 5 is a front view of another garment incorporating an abrasion-resistant fabric according to the invention.

FIG. 5 illustrates a protective jacket 30 incorporating the abrasion-resistant fabric of the present invention cut in elbow patches 31 and 32 and shoulder patches 33 and 34 sewn inside the jacket to protect the elbows and shoulders of the wearer from abrasion injury to the skin. The fabric is identical to that described above. In addition, the fabric is applicable to other garments, such as T-shirts and sports pants.

A protective garment is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a protective garment, the improvement comprising an abrasion-resistant fabric attached to an inside of the garment, and having a face side residing adjacent the garment and a back side for residing nearest the wearer, said fabric comprising:

a body yarn;

an elastic yarn incorporated with said body yarn;

a high performance yarn incorporated with said body yarn and said elastic yarn, and terried to form loops extending from the face side of the fabric adjacent the garment, said high performance yarn having a tensile strength of at least 7 grams per denier; and wherein said abrasion-resistant fabric has minimum of 10% stretch in both warp and fill directions, and a melting temperature in excess of 600 degrees F.

2. A protective garment according to claim 1, wherein the body yarn of said fabric comprises fibers selected from the group consisting of nylon, cotton, flax, and hemp.

3. A protective garment according to claim 1, wherein the elastic yarn of said fabric comprises spandex fibers.

4. A protective garment according to claim 1, wherein the high performance yarn of said fabric comprises aramid fibers.

5. A protective garment according to claim 1, wherein the fabric is attached to an inside of the garment by sewing stitches.

6. A protective garment according to claim 1, wherein the garment comprises pants.

7. A protective garment according to claim 6, wherein the fabric is cut to form a protective knee patch sewn to an inside of the pants in an area of the knee of the wearer.

8. A protective garment according to claim 6, wherein the fabric is cut to form a protective seat patch sewn to an inside of the pants in an area of the seat of the wearer.

9. A protective garment according to claim 1, wherein the garment comprises a coat.

10. A protective garment according to claim 9, wherein the fabric is cut to form a protective elbow patch sewn to an inside of the coat in an area of the elbow of the wearer.

11. A protective garment according to claim 1, wherein the yarns of said fabric are knit.

12. A protective garment according to claim 1, wherein the yarns of said fabric are woven.

13. An abrasion-resistant fabric adapted for being attached to a protective garment, and having a face side for residing adjacent the garment and a back side for residing nearest the wearer, said fabric comprising:

a body yarn;

an elastic yarn incorporated with said body yarn; and a high performance yarn incorporated with said body yarn and said elastic yarn, and terried to form loops extending from the face side of the fabric adjacent the garment, said high performance yarn having a tensile strength of at least 7 g/denier; and wherein said abrasion-resistant fabric has a minimum of 10% stretch in both warp and fill directions, and a melting temperature in excess of 600 degrees F.

* * * * *